US010072587B2

(12) United States Patent
Ifuku et al.

(10) Patent No.: US 10,072,587 B2
(45) Date of Patent: Sep. 11, 2018

(54) THROTTLE OPERATING DEVICE

(71) Applicant: MAKITA CORPORATION, Aichi (JP)

(72) Inventors: Yasuo Ifuku, Aichi (JP); Tomoaki Sato, Aichi (JP); Masahiro Ito, Aichi (JP)

(73) Assignee: MAKITA CORPORATION, Aichi (JP)

( * ) Notice: Subject to any disclaimer, the term of this patent is extended or adjusted under 35 U.S.C. 154(b) by 286 days.

(21) Appl. No.: 14/865,553

(22) Filed: Sep. 25, 2015

(65) Prior Publication Data

US 2016/0090919 A1 Mar. 31, 2016

(30) Foreign Application Priority Data

Sep. 29, 2014 (JP) ..... 2014-199135

(51) Int. Cl.
*F02D 9/02* (2006.01)
*F02D 11/04* (2006.01)

(52) U.S. Cl.
CPC ..... *F02D 9/02* (2013.01); *F02D 11/04* (2013.01); *F02D 2009/0208* (2013.01)

(58) Field of Classification Search
CPC ..... F02D 9/02; F02D 11/04; F02D 2009/0208
USPC ..... 123/403, 399–402; 74/500.5
See application file for complete search history.

(56) References Cited

U.S. PATENT DOCUMENTS 5,718,052 A * 2/1998 Taomo ..... F02B 63/02 123/198 D
5,765,445 A * 6/1998 Miyata ..... G05G 1/04 56/DIG. 18
5,865,155 A * 2/1999 Nagashima ..... F02B 63/02 123/398
5,884,462 A * 3/1999 Gerber ..... A01D 34/001 56/12.1
5,916,331 A * 6/1999 Nagashima ..... F02B 63/02 74/506
5,934,149 A * 8/1999 Tuda ..... F16C 1/262 30/382

(Continued)

FOREIGN PATENT DOCUMENTS

JP 2013-100800 5/2013

OTHER PUBLICATIONS

Japanese Office Action dated Oct. 31, 2017 in counterpart Appln. No. 2014-199135, and a partial English-language translation.

*Primary Examiner* — Stephen K Cronin
*Assistant Examiner* — Susan Scharpf
(74) *Attorney, Agent, or Firm* — Greenblum & Bernstein, P.L.C.

(57) ABSTRACT

A throttle operating device that adjusts the opening degree of an engine throttle valve is provided. In a throttle operating device according to an aspect of the invention, one end of an inner cable inserted through an outer tube is fixed to a cable fixing part provided in a throttle lever, and the opening degree of the engine throttle valve is adjusted via the inner cable by rotationally operating the throttle lever. The one end of the inner cable is fixed to the cable fixing part with the extending direction of the inner cable changed within the throttle lever. Additionally, a moving mechanism that moves the cable fixing part along a longitudinal direction of the inner cable, is provided in the throttle lever.

12 Claims, 8 Drawing Sheets

(56) References Cited

U.S. PATENT DOCUMENTS

| | | | | |
|---|---|---|---|---|
| 6,006,625 | A * | 12/1999 | Nagashima | F02B 63/02 74/488 |
| 6,032,370 | A * | 3/2000 | Nagashima | A01D 34/90 188/166 |
| 6,056,668 | A * | 5/2000 | Nagashima | A01G 3/062 30/276 |
| 6,196,082 | B1 * | 3/2001 | Iwata | F02D 11/02 30/276 |
| 6,799,555 | B2 * | 10/2004 | Luithardt | F02D 11/02 123/400 |
| 6,918,451 | B2 * | 7/2005 | Nagashima | F16D 49/08 173/221 |
| 8,857,138 | B2 * | 10/2014 | Hansen | F02N 11/0803 56/10.8 |
| 9,127,658 | B2 * | 9/2015 | Koenen | F04B 17/05 |
| 2009/0119933 | A1 * | 5/2009 | Mace | A01G 3/08 30/381 |
| 2011/0126502 | A1 * | 6/2011 | Pitman | A01D 34/68 56/10.8 |
| 2014/0000543 | A1 * | 1/2014 | Karrar | F02M 1/02 123/179.9 |

* cited by examiner

ENLARGED VIEW OF PORTION A

C-C SECTIONAL VIEW

VIEW AS SEEN FROM ARROW F

G-G SECTIONAL VIEW

I-I SECTIONAL VIEW

THROTTLE OPERATING DEVICE

CROSS-REFERENCE TO RELATED APPLICATION

The application claims priority from Japanese Patent Application No. 2014-199135, filed on Sep. 29, 2014, the entire contents of which are incorporated herein by reference.

BACKGROUND OF THE INVENTION

1. Field of the Invention

The present invention relates to a throttle operating device that adjusts the opening degree of a throttle valve of an internal combustion engine (engine), and in particular, relates to a throttle operating device that is suitable for use in a portable work machine having an engine as a driving source.

2. Description of Related Art

Generally, throttle operating devices for use in portable work machines having an engine as a driving source have a throttle lever that is rotationally operated by an operator. One end of an inner cable inserted through an outer tube of a throttle cable (Bowden cable) is coupled to the throttle lever, and the other end of the inner cable is coupled to a valve opening and closing member that opens and closes the throttle valve. The throttle operating device is configured so as to adjust the opening degree of the throttle valve via the throttle cable (inner cable) when the throttle lever is rotationally operated by an operator.

The tension of the inner cable is appropriately adjusted as necessary at the time of checking before work, during replacement of the throttle cable, etc. In the related art, the adjustment of the tension of the inner cable has been performed by moving a fixed position of the end of the outer tube on an engine side, that is, the end of the outer tube opposite to a throttle lever side (refer to, for example, Japanese Patent Application Laid-Open Publication No. 2013-100800).

However, the end of the outer tube on the engine side is arranged apart from the throttle lever, and is arranged inside a cover member that covers the outside of the engine, etc. Additionally, in the adjustment work of the tension of the inner cable, the operator needs to rotationally operate the throttle lever to check the tension of the inner cable. For this reason, in the related art, the adjustment (particularly, fine adjustment) of the tension of the inner cable is not easy, and there is room for improvement in terms of workability.

Thus, an object of the invention is to provide a throttle operating device capable of more easily adjusting the tension of an inner cable compared to the related art.

SUMMARY OF THE INVENTION

According to an aspect of the invention, there is provided a throttle operating device that adjusts the opening degree of an engine throttle valve. The throttle operating device includes: a throttle lever that is rotationally operated; a cable fixing part provided in the throttle lever; an inner cable that is inserted through an outer tube, the inner cable having one end fixed to the cable fixing part, and the other end coupled to a valve opening and closing member that opens and closes the throttle valve; and a moving mechanism that is provided in the throttle lever and moves the cable fixing part along a longitudinal direction of the inner cable. The one end of inner cable is fixed to the cable fixing part with the extending direction of the inner cable changed within the throttle lever.

Other objects and features of aspects of the present invention will be understood from the following description with reference to the accompanying drawings.

DESCRIPTION OF THE PREFERRED EMBODIMENTS

Figure 1:
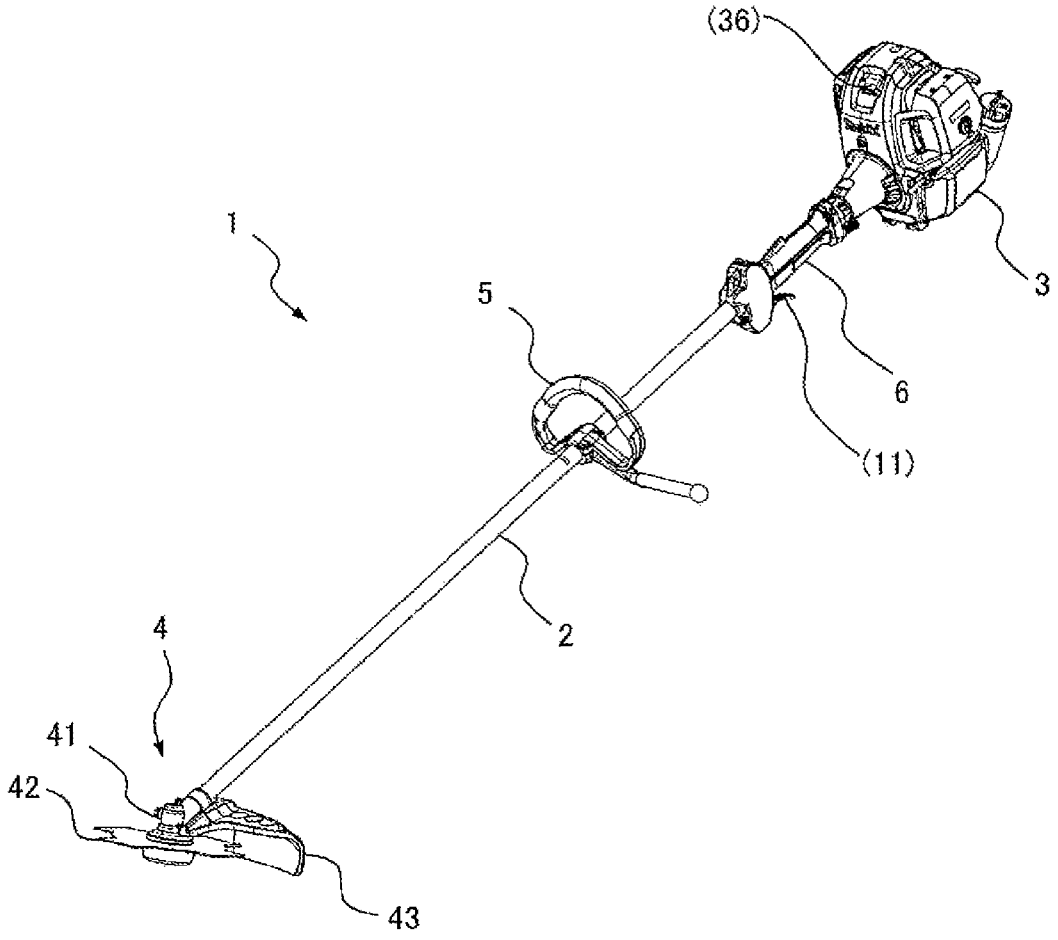
FIG. 1 is a view illustrating the external appearance of a brush/weed cutter (portable work machine) to which the invention is applied.

Hereinafter, embodiments of the invention will be described with reference to the accompanying drawings. FIG. 1 illustrates the external appearance of a brush cutter (weed cutter) 1 that is an example of a portable work machine to which the invention is applied. As illustrated in FIG. 1, the brush cutter 1 has an operating rod 2, a power unit 3 provided at the rear end of the operating rod 2, a working unit 4 (a gear head 41, a cutting blade 42, and a scattering protective cover 43) provided at the front end of the operating rod 2, a handle 5 attached to an intermediate portion of the operating rod 2, and a grip 6 attached to the operating rod 2 ahead of the power unit 3. Usually, an operator holds the handle 5 with one hand (usually the left hand), and holds the grip 6 with the other hand (usually the right hand) to operate the brush cutter 1.

The operating rod 2 has a hollow pipe shape, and extends linearly. A drive shaft (not illustrated) is housed inside the operating rod 2. The drive shaft transmits the output (rotation, torque) of the power unit 3 (more specifically, an engine 31 to be described below) to the gear head 41 of the working unit 4, and thereby rotates the cutting blade 32.

Figure 2:
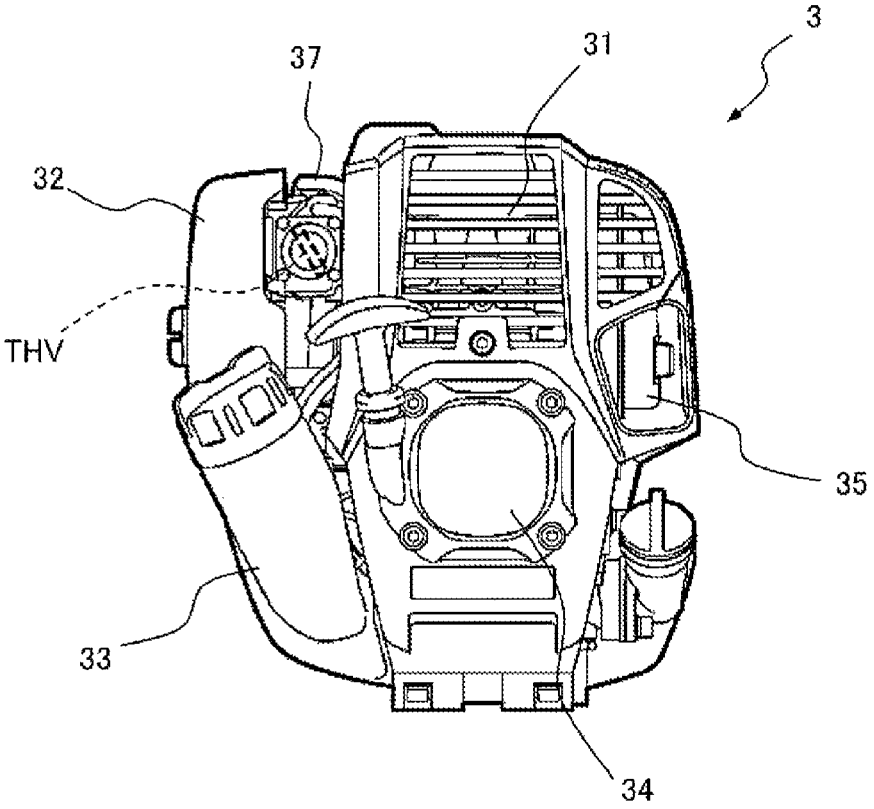
FIG. 2 is a view illustrating a state in which a power unit of the brush/weed cutter is seen from a rear side.

FIG. 2 illustrates a state in which the power unit 3 is seen from a rear side. As illustrated in FIG. 2, the power unit 3 includes an engine 31, an air cleaner 32, a fuel tank 33, a recoil starter 34, and an exhaust muffler 35. The engine 31 is provided with an ignition plug 36 (refer to FIG. 1) and a carburetor 37. The carburetor 37 is a device that mixes fuel with air that has passed through the air cleaner 32 to form an air-fuel mixture, and supplies the formed air-fuel mixture to the engine 31. The carburetor 37 has a throttle valve THV illustrated by a dashed line in FIG. 2 built therein. The throttle valve THV is always urged in the closing direction, that is, urged to a minimum opening degree (idling rotation opening degree), and the opening degree thereof is adjusted by a throttle operating device to be described below.

First Embodiment

First, a first embodiment of the throttle operating device will be described.

Figure 3:
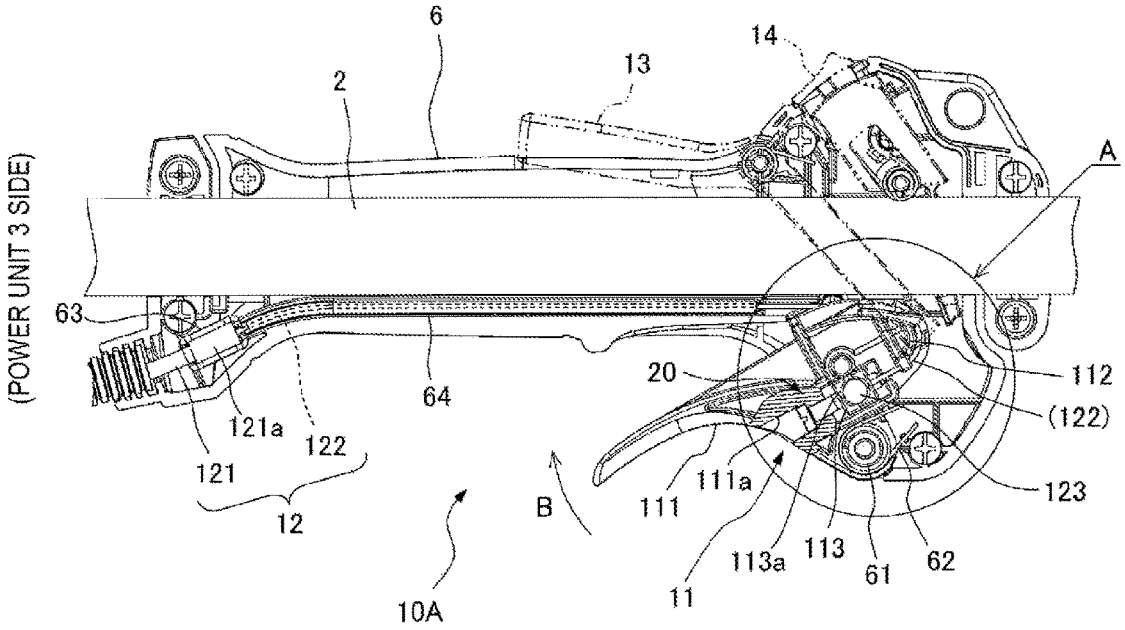
FIG. 3 is a view for describing the configuration of a throttle operating device according to a first embodiment applied to the brush/weed cutter, and is a view illustrating the internal structure of a grip of the brush/weed cutter.
Figure 4:
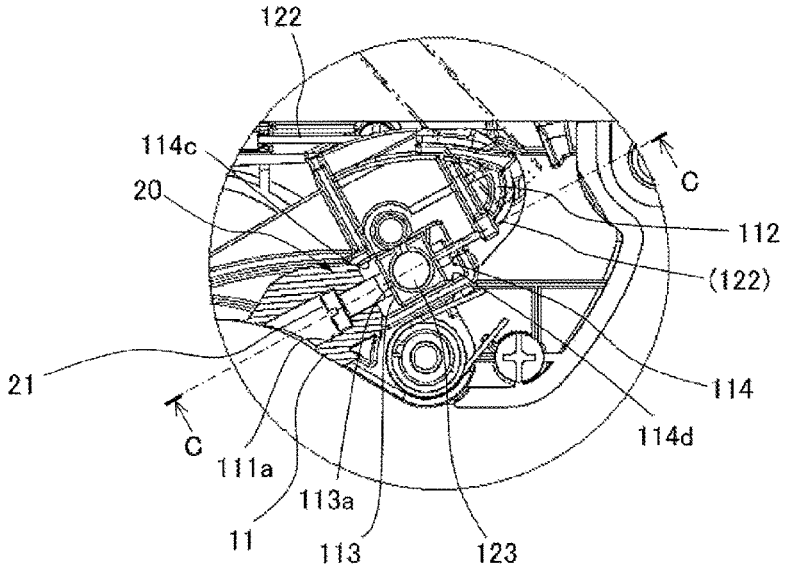
FIG. 4 is an enlarged view of portion A of FIG. 3.

FIGS. 3 and 4 are views for describing the configuration of a throttle operating device 10A according to the first embodiment. FIG. 3 is a view illustrating the internal structure of the grip 6, and FIG. 4 is an enlarged view of portion A of FIG. 3. The grip 6 is constituted of a pair of left and right split cases that are arranged with the operating rod 2 sandwiched therebetween and split into two, and only one case of the cases is illustrated in FIG. 3. The throttle operating device 10A according to the first embodiment includes a throttle lever 11, which is rotationally operated by the operator, and a throttle cable 12.

The throttle lever 11 is provided on a front end side of the grip 6, that is, on a side separated from the power unit 3 (refer to FIG. 1). The throttle cable 12 is constituted of a so-called Bowden cable, and has an outer tube 121 and an inner cable 122 inserted through the outer tube 121. The throttle lever 11 is coupled to a valve opening and closing member (not illustrated) that opens and closes the throttle valve THV, which is provided in the carburetor 37 of the engine 31, via the inner cable 122. That is, one end of the inner cable 122 is fixed to the throttle lever 11, and the other end of the inner cable 122 is fixed to the valve opening and closing member.

The throttle operating device 10A is configured so as to adjust the opening degree of the throttle valve THV of the engine 31 via the inner cable 122 (and the valve opening and closing member) according to an amount of rotational operation of the throttle lever 11 by the throttle lever 11 being rotationally operated by the operator.

Although detailed description herein is omitted, the throttle operating device 10A according to the present embodiment is provided with a lock-releasing lever 13 illustrated by an imaginary line in FIG. 3. The throttle operating device 10A is configured so as to be unable to rotationally operate the throttle lever 11 unless the lock-releasing lever 13 is operated. Additionally, the throttle operating device 10A is provided with a half locking lever 14 similarly illustrated by an imaginary line, and the throttle operating device 10A is configured such that the throttle lever 11 is fixed at a predetermined position and thereby fixed at a position in which the throttle valve THV is slightly opened when the half locking lever 14 is operated. For example, by adjusting (opening) the opening degree of the throttle valve THV before starting the engine using the half locking lever 14, it is possible to send more fuel to a combustion chamber when the engine starts. For this reason, engine starting performance (including restart performance) is able to be improved by appropriately using the half locking lever 14.

Hereinafter, the configuration of the throttle operating device 10A according to the first embodiment will be described. The throttle lever 11 has an operating part 111 that is exposed outside of the grip 6, and is rotatably supported by a shaft 61 provided within the grip 6. The shaft 61 is erected from, for example, an inner wall of the case that constitutes the grip 6. The throttle lever 11 is always urged to an initial rotation position (state illustrated in FIG. 3) by a torsion coil spring 62 mounted on the shaft 61. The throttle lever 11 is usually rotated in the direction of arrow B in FIG. 3 from the initial rotation position by the operating part 111 being pulled with the index finger of a hand (right hand) of the operator who holds the grip 6.

Additionally, the throttle lever 11 has a substantially U-shaped cable guide part 112 that is erected from a region located within the grip 6 and becomes convex to a side opposite to the operating part 111, in other words, convex in a direction moving away from the operating part 11, and a cable fixing part 113 that is arranged on an imaginary extension line of the cable guide part 112. In addition, the imaginary extension line does not need to be an accurate (strict) extension line of the cable guide part 112, and slight deviation is allowable.

The cable guide part 112 changes the extending direction of the inner cable 122, which extends from a throttle lever side end 121*a* of the outer tube 121, in the middle of the inner cable 122. Specifically, the extending direction of the inner cable 122 is changed by making the inner cable 122 follow the cable guide part 112 to bend the inner cable 122. In addition, the throttle lever side end 121*a* of the outer tube 121 is fixed and held by a holding part 63 provided at a predetermined position on the power unit 3 side within the grip 6.

That is, in the present embodiment, the inner cable 122 exiting from the throttle lever side end 121*a* of the outer tube 121 extends to the throttle lever 11 through an internal space in the tubular body 64 that is installed substantially parallel to the operating rod 2 within the grip 6, and then the inner cable 122 is bent at an acute angle along the cable guide part 112 within the throttle lever 11, and the inner cable 122 is changed in direction. Accordingly, the inner cable 122 extending from the throttle lever side end 121*a* of the outer tube 121 makes a substantially U-shaped turn within the throttle lever 11, and one end thereof heads to the cable fixing part 113. Then, a cable terminal 123 anchored to the one end of the inner cable 122 is mounted on a metal fitting mounting portion 113*a* that is formed at the cable fixing part 113. Accordingly, the one end of the inner cable 122 is fixed to the cable fixing part 113 provided in the throttle lever 11.

Here, in the present embodiment, the cable fixing part 113 is configured separately from the throttle lever 11, and is arranged within the throttle lever 11 so as to be movable along the imaginary extension line, in other words, along a longitudinal direction of the inner cable 122 extending from the cable guide part 112 to the cable fixing part 113. More specifically, the cable fixing part 113 is housed within a housing portion 114 formed at the throttle lever 11, and is configured so as to be movable along the longitudinal direction of the inner cable 122 inside the housing portion 114 by means of a moving mechanism 20, to be described below.

Figure 5:
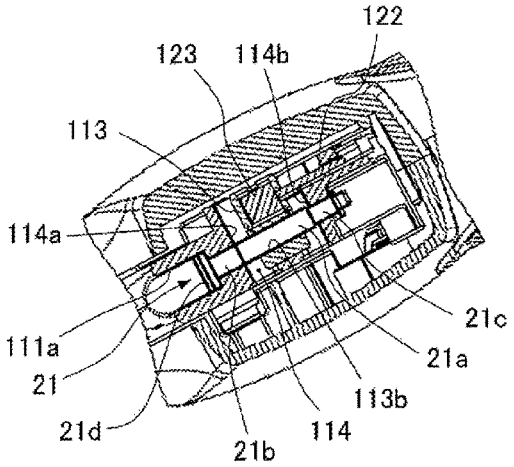
FIG. 5 is a view for describing a moving mechanism of the throttle operating device according to the first embodiment, and is a C-C sectional view of FIG. 4.

FIG. 5 is a view for describing the moving mechanism 20 that moves the cable fixing part 113, and is a C-C sectional view of FIG. 4. As illustrated in FIG. 5, in the present embodiment, the cable fixing part 113 is formed with a female thread portion 113*b* that passes through the cable fixing part 113 along the imaginary extension line, and an adjustable screw member 21 that constitutes the moving mechanism 20 is screwed into the female thread portion 113*b*.

In the adjustable screw member 21, an under-head portion 21*b* and a tip-side portion 21*c*, which sandwich a trunk portion 21*a* having a male thread portion screwed into the female thread portion 113*b* of the cable fixing part 113, are rotatably supported by mutually facing inner walls 114*a* and 114*b* of the housing portion 114, respectively. The head portion 21*d* of the adjustable screw member 21 is exposed to an outer surface of the operating part 111 of the throttle lever 11, in other words, into a concave portion 111*a* that is formed in the outer surface of the operating part 111 of the throttle lever 11. Additionally, the head portion 21*d* of the adjustable screw member 21 is formed with a concave groove into which a tip portion of a tool, such as a flathead screwdriver, is insertable. In addition, the co-rotation of the cable fixing part 113 with the adjustable screw member 21 is prevented by a pair of inner walls 114*c* and 114*d* of the housing portion 114 that are parallel to the axis of the adjustable screw member 21 (refer to FIG. 4).

The moving mechanism 20 in the present embodiment is configured so as to move the cable fixing part 113, in a direction moving away from the cable guide part 112, that is, in a direction in which the inner cable 122 is pulled, thereby holding the cable fixing part 113 in place as it is (position after the movement), if the adjustable screw member 21 rotates in a first direction. Additionally, the moving mechanism 20 in the present embodiment is configured so as to move the cable fixing part 113, in a direction approaching the cable guide part 112, that is, in a direction in which the inner cable 122 is loosened, thereby holding the cable fixing part 113 in place as it is, if the adjustable screw member 15 rotates in a second direction opposite to the first direction. That is, the moving mechanism 20 in the present embodiment includes a so-called feed screw mechanism, and is configured so as to be able to move the cable fixing part 113 to thereby change the tension of the inner cable 122.

Next, the operation of the throttle operating device 10A configured as described above will be described.

First, the throttle lever 11 in a non-operated state is urged by the torsion coil spring 62 and is located at the initial rotation position (refer to FIG. 3). Then, when the throttle lever 11 is located at the initial rotation position, the opening degree of the throttle valve THV is the idling rotation opening degree (minimum opening degree).

If an operator rotationally operates the throttle lever 11 while operating the lock-releasing lever 13, the throttle operating device 10A opens the throttle valve THV via the inner cable 122 (and the valve opening and closing member). Specifically, the inner cable 122 is pulled by the movement of the cable guide part 112 accompanying the rotational operation of the throttle lever 11 by the operator, and thereby, the throttle valve THV is opened from the idling rotation opening degree to an opening degree according to the amount of rotational operation of the throttle lever 11.

Figure 6:
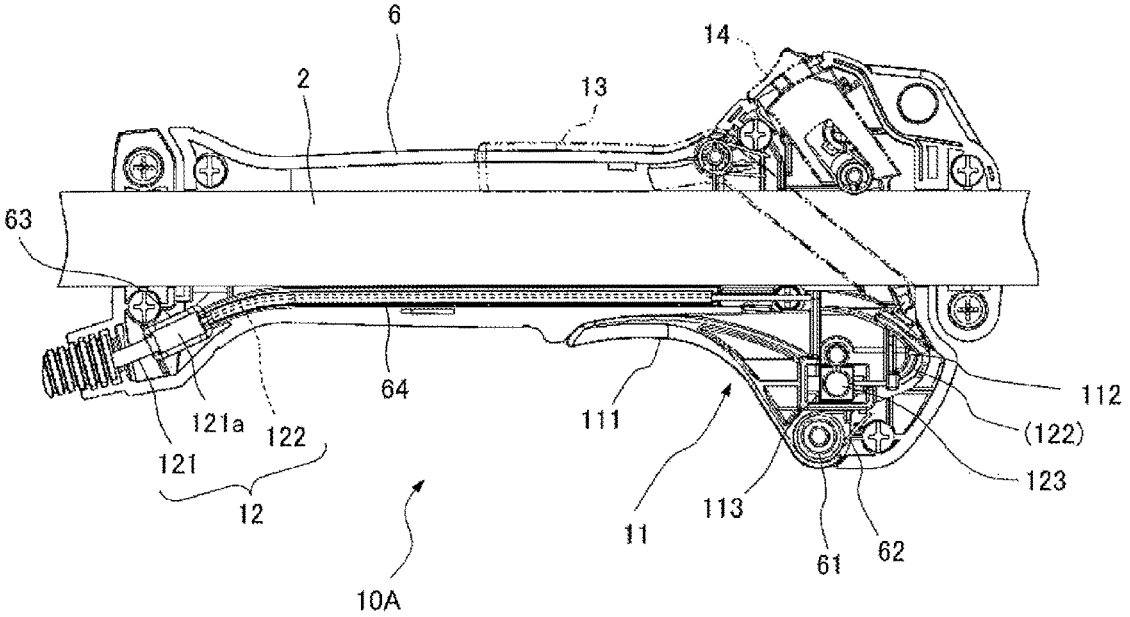
FIG. 6 is a view illustrating a state in which a throttle lever is rotationally operated to a maximum rotation position, in the throttle operating device according to the first embodiment.

The operator is able to rotationally operate the throttle lever 11 to the maximum rotation position illustrated in FIG. 6 to fully open the throttle valve THV, that is, bring the opening degree of the throttle valve THV to the maximum opening degree.

Then, if the operator stops the rotational operation of the throttle lever 11 and lifts the operator's hand (finger) from the throttle lever 11, the throttle lever 11 returns to the initial rotation position, and the opening degree of the throttle valve THV returns to the idling rotation opening degree (minimum opening degree). Thereafter, the operator is able to operate, for example, a stop switch (not illustrated), etc., provided in the grip 6 to thereby stop the engine 31.

Additionally when the engine 31 is stopped, the operator is able to move the cable fixing part 113 along the longitudinal direction of the inner cable 122 by means of the moving mechanism 20 provided in the throttle lever 11, thereby changing and adjusting the tension of the inner cable 122. Specifically, the operator is able to appropriately rotate the adjustable screw member 15 using the flathead screwdriver, etc., thereby moving the cable fixing part 113 along the longitudinal direction of the inner cable 122 to change and adjust the tension of the inner cable 122.

In the throttle operating device 10A according to the present embodiment, the inner cable 122 extending from the throttle lever side end 121*a* of the outer tube 121 is changed in direction within the throttle lever 11, and then, one end (cable terminal 123) thereof is fixed to the cable fixing part 113 provided in the throttle lever 11. Additionally, the throttle operating device 10A has the moving mechanism 20, which moves the cable fixing part 113 along the longitudinal direction of the inner cable 122 to hold the cable fixing part 113 in place as it is, within the throttle lever 11.

Therefore, the operator is able to perform the change (adjustment) of the tension of the inner cable 122 by the moving mechanism 20, and the checking of the tension of the inner cable 122 by the rotational operation of the throttle lever 11, at the substantially same position. For this reason, the workability of the adjustment work of the tension of the inner cable 122 is improved. Additionally, since the throttle operating device 10A is configured to change the extending direction of the inner cable 122 within the throttle lever 11, the desired degree of freedom in the arrangement of the adjusting mechanism 20 within the throttle lever 11 is able to be obtained, and the adjusting mechanism 20 is able to be arranged at a suitable position within the throttle lever 11.

Here, in the present embodiment, the throttle lever 11 has the cable guide part 112 for bending the inner cable 122 extending from the throttle lever side end 121*a* of the outer tube 121 and changing the extending direction of the inner cable 122. For this reason, the change of the extending direction of the inner cable 122 within the throttle lever 11 is stably performed, and malfunctions (variations, etc.) accompanied by changing the extending direction of the inner cable 122 are reduced.

Additionally, in the present embodiment, the inner cable 122 is bent at an acute angle within the throttle lever 11 and changed in direction. That is, the inner cable 122 is arranged so as to make a substantially U-shaped turn within the throttle lever 11. For this reason, it is possible to arrange the cable fixing part 113 and the moving mechanism 20, for example, at the operating part 111 of the throttle lever 11 exposed outside of the grip 6 or in the vicinity of the operating part 111. Accordingly, an operator's access to the moving mechanism 20 is facilitated, and the workability of the adjustment work of the tension of the inner cable 122 is further improved.

Additionally, in the present embodiment, the moving mechanism 20 includes the adjustable screw member 21 that is screwed into the female thread portion 113*b* formed in the cable fixing part 113. Also, the moving mechanism 20 is configured so as to move the cable fixing part 113 in the direction in which the inner cable 122 is pulled by the adjustable screw member 21 being rotated in the first direction, and so as to move the cable fixing part 113 in the direction in which the inner cable 122 is loosened by the adjustable screw member 21 being rotated in the second direction. For this reason, the tension of the inner cable 122 is able to be finely changed, and the tension of the inner cable 122 is also be easily and finely adjusted.

In particular, in the present embodiment, the head portion 21*d* of the adjustable screw member 21 that constitutes the moving mechanism 20 is exposed to the outer surface of a throttle lever 11, and more specifically, is exposed to the inside of the concave portion 111*a* that is formed in the outer surface of the operating part 111 of the throttle lever 11. For this reason, unintentional rotational operation of the adjustable screw member 21 (that is, the change of the tension of the inner cable 122) is prevented while operator's access to the head portion 21*d* of the adjustable screw member 21 and the rotational operation of the adjustable screw member 21 are facilitated.

In addition, in the above-described embodiment, the cable guide part 112 provided in the throttle lever 11 is formed in a substantial U-shape that becomes convex to the side opposite to the operating part 111 of the throttle lever 11. However, the invention is not limited thereto. The cable guide part 112 just has to be configured so as to be capable of smoothly changing the direction of the inner cable 122 and pulling the inner cable 122 with the rotational operation of the throttle lever 11, and the shape and configuration thereof are able to be set as needed.

Additionally, in the above-described embodiment, the moving mechanism 20 includes the so-called feed screw mechanism. However, the invention is not limited thereto. The moving mechanism 20 just has to be capable of moving the cable fixing part 113 along the longitudinal direction of the inner cable 122 to hold the cable fixing part 113 in place as it is, and configurations other than feed screw mechanism may also be adopted as the configuration of the moving mechanism 20.

Second Embodiment

Next, a second embodiment of a throttle operating device will be described.

Figure 7:
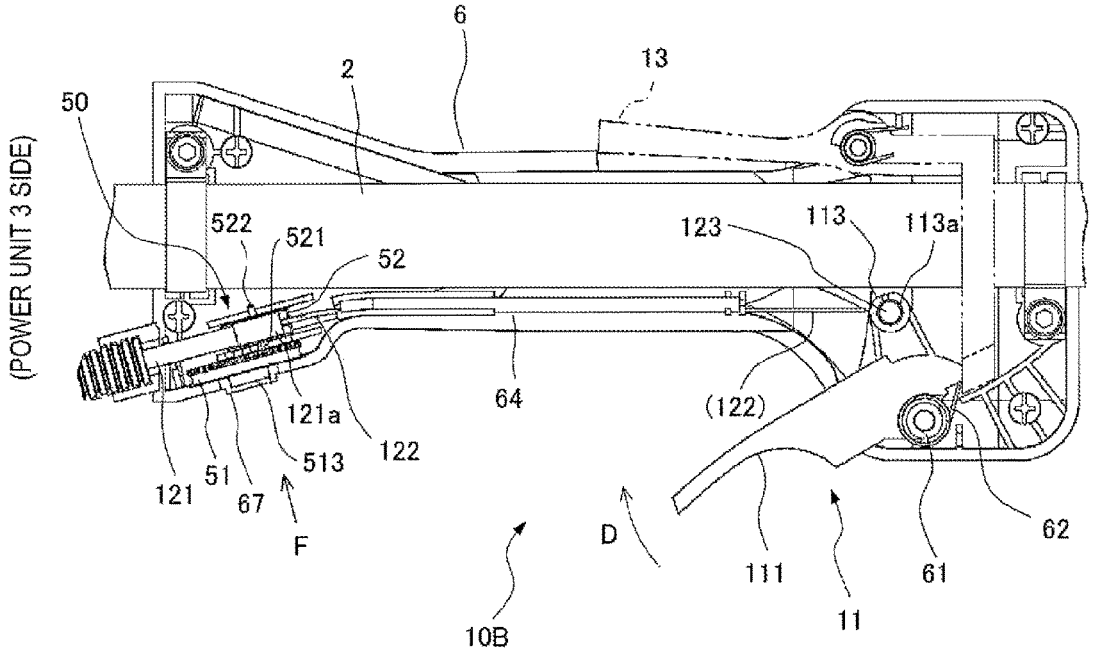
FIG. 7 is a view for describing the configuration of a throttle operating device according to a second embodiment applied to the brush/weed cutter, and is a view illustrating the internal structure of the grip of the brush/weed cutter.

FIG. 7 is a view for describing the configuration of a throttle operating device 10B according to the second embodiment, and illustrates the internal structure of the grip 6, similar to FIG. 3. In the following, the same constituent elements as the constituent elements of the throttle operating device 10A according to the first embodiment will be designated by the same reference numerals, and the description thereof will be appropriately omitted.

The main differences between the throttle operating device 10A according to the first embodiment and the throttle operating device 10B according to the second embodiment are as follows, and configurations other than these differences are basically the same.

(1) In the throttle operating devices 10A according to the first embodiment, the cable fixing part 113 is configured separately from the throttle lever 11. In contrast, in the throttle operating device 10B according to the second embodiment, the cable fixing part 113 is configured integrally with the throttle lever 11.

(2) The throttle operating device 10A according to the first embodiment has the moving mechanism 20 that moves the cable fixing part 113 along the longitudinal direction of the inner cable 122. In contrast, the throttle operating device 10B according to the second embodiment has a moving mechanism 50 that moves the throttle lever side end 121*a* of the outer tube 121 along the longitudinal direction of the inner cable 122.

(3) The half locking lever 14 is provided in the throttle operating device 10A according to the first embodiment. In contrast, the half locking lever 14 is not provided in the throttle operating device 10B according to the second embodiment.

Hereinafter, the configuration of the throttle operating device 10B according to the second embodiment will be described mainly regarding the differences from the throttle operating device 10A according to the first embodiment.

As illustrated in FIG. 7, in the present embodiment, the inner cable 122 exiting from the throttle lever side end 121*a* of an outer tube 121 extends to the throttle lever 11 through the internal space in the tubular body 64 disposed substantially parallel to the operating rod 2 within the grip 6, and the cable terminal 123 anchored to one end of the inner cable 122 is mounted on the metal fitting mounting portion 113*a* that is formed in the cable fixing part 113. Accordingly, the one end of the inner cable 122 is fixed to the cable fixing part 113. The throttle lever 11 is always urged to the initial rotation position (state illustrated in FIG. 7) by the torsion coil spring 62 that is mounted on the shaft 61. The throttle lever 11 is rotated in a direction of arrow D from the initial rotation position by the operating part 111 being pulled with the index finger of a hand (the right hand) of the operator who holds the grip 6.

Additionally, as described above, in the present embodiment, the moving mechanism 50, which moves the throttle lever side end 121*a* of the outer tube 121 along the longitudinal direction of the inner cable 122, is provided instead of the moving mechanism 20 in the first embodiment. The moving mechanism 50 has a substantially disc-shaped rotation operating part 51 that is rotationally operated by the operator, and a tube holding part 52 that fixes and holds the throttle lever side end 121*a* of the outer tube 121.

Figure 8:
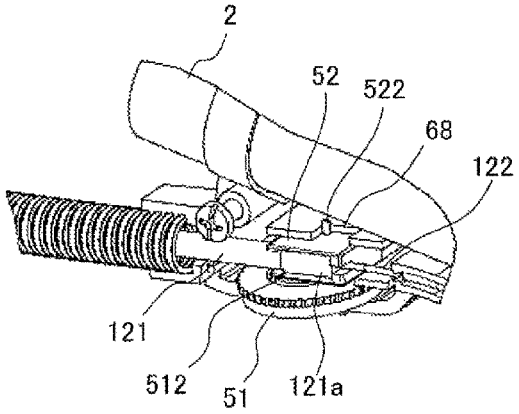
FIG. 8 is a schematic perspective view illustrating the configuration of a moving mechanism of the throttle operating device according to the second embodiment.
Figure 9:
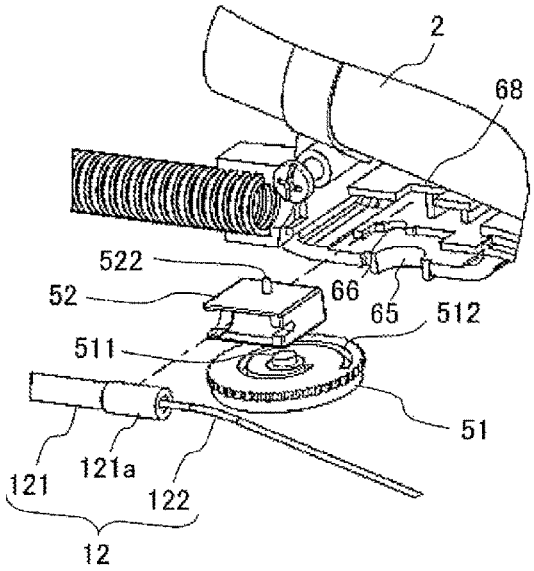
FIG. 9 is a schematic exploded perspective view of the moving mechanism of the throttle operating device according to the second embodiment.
Figure 10:
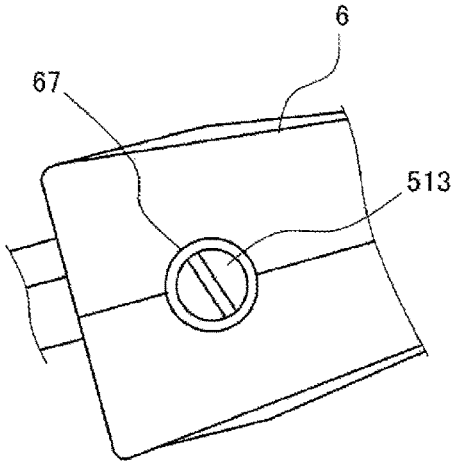
FIG. 10 is a view as seen from the direction of arrow F of FIG. 7.

FIGS. 8 to 10 are views for describing the configuration of the moving mechanism 50. FIG. 8 is a schematic perspective view illustrating the configuration of the moving mechanism 50, FIG. 9 is a schematic exploded perspective view of the moving mechanism 50, and FIG. 10 is a view as seen from arrow F of FIG. 7.

As illustrated in FIGS. 7 to 9, a first shaft 511 is formed at the center of the side surface of the rotation operating part 51 on the outer tube 121 side, and a spiral groove 512 is formed around the first shaft 511. A second shaft 513 having a larger diameter than that of the first shaft 511 is formed at the center of the side surface of the rotation operating part 51 opposite to the outer tube 121 side. In the rotation operating part 51, the first shaft 511 and the second shaft 513 are rotatably supported by support parts 65 and 66 (only lower halves of both of the support parts are illustrated in FIG. 9) that are respectively provided on the grip 6.

As illustrated in FIG. 10, a tip surface of the second shaft 513 is formed with a concave groove into which a tip portion of a tool, such as a flathead screwdriver, is insertable. Additionally, the tip surface of the second shaft 513 is exposed to the outer surface of the grip 6 such that the operator is able to access it. More specifically, the second shaft 513 is exposed to the inside of a ring-shaped projection 67 that is formed on the outer surface of the grip 6 (refer to FIG. 7).

The tube holding part 52 is formed in a rectangular box shape that has a tube mounting portion on an upper portion thereof on which the throttle lever side end 121*a* of the outer tube 121 is mounted. The tube holding part 52 has a first pin 521 that is formed on the side surface thereof on the rotation operating part 51 side and is inserted into the spiral groove 512 of the rotation operating part 51, and a second pin 522 that is formed on the side surface thereof opposite to the rotation operating part 51. The second pin 522 is supported so as to be movable within a predetermined range along the longitudinal direction of the inner cable 122 by a pin support part 68 provided within the grip 6.

Next, the operation of the moving mechanism 50 in the present embodiment will be described with reference to FIGS. 11A, 11B, 12A, and 12B.

Figure 11A:
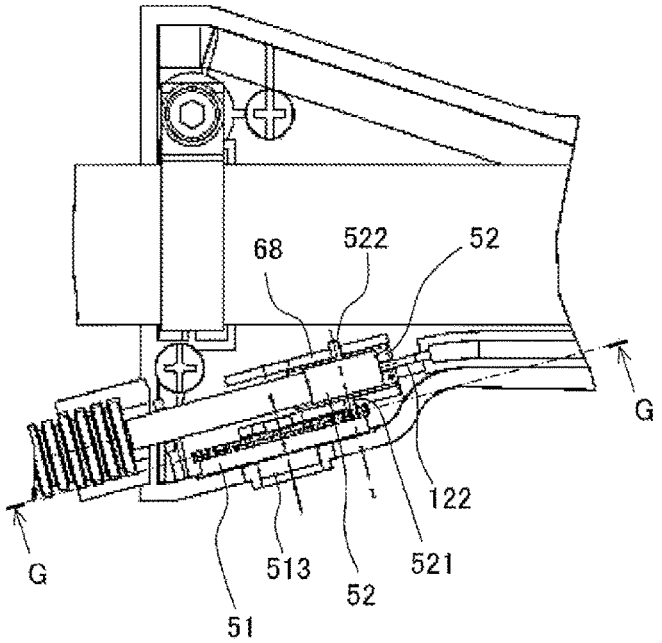
FIG. 11A is a view for describing the operation of the moving mechanism of the throttle operating device according to the second embodiment, and is a view illustrating the main part of the internal structure of the grip of the brush/weed cutter.
Figure 11B:
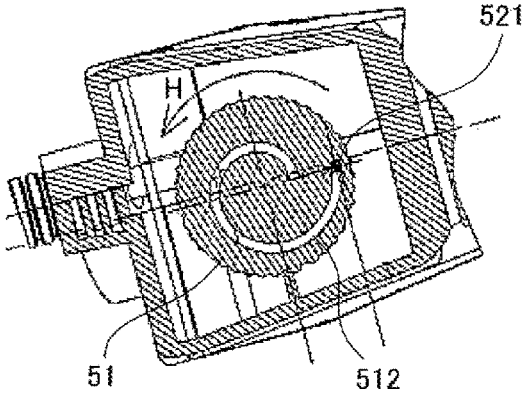
FIG. 11B is a G-G sectional view of FIG. 11A.

FIG. 11A illustrates the main part of the internal structure of the grip 6 in a state in which the throttle lever side end 121*a* of the outer tube 121 is brought closest to the throttle lever 11, and FIG. 11B is a G-G sectional view of FIG. 11A.

As illustrated in FIGS. 11A and 11B, the first pin 521 of the tube holding part 52 is located at an outer end of the groove 512 formed in the rotation operating part 51, in a state in which the throttle lever side end 121*a* (that is, the tube holding part 52) of the outer tube 121 is brought closest to the throttle lever 11 (refer to FIG. 11B). Additionally, the second pin 522 is located in the pin support part 68 on a side closest to the throttle lever 11 (refer to FIG. 11A).

If the rotation operating part 51 is rotated in the direction of arrow H from a state illustrated in FIGS. 11A and 11B, since the first pin 521 is inserted into the spiral groove 512, the tube holding part 52 moves (moves linearly) in a direction moving away from the throttle lever 11. Accordingly, the throttle lever side end 121*a* of the outer tube 121 moves in the direction moving away from the throttle lever 11, that is, in the direction in which the tension of the inner cable 122 is strengthened, and is held in place as it is.

Figure 12A:
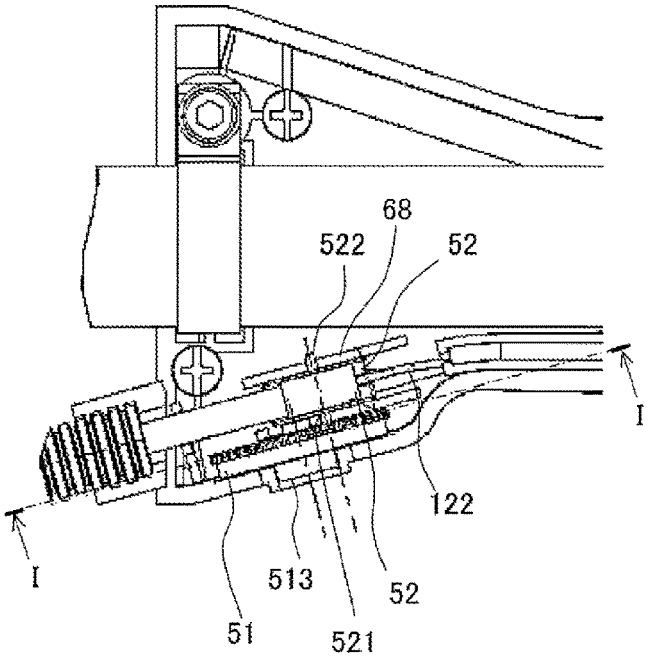
FIG. 12A, similar to FIG. 11A, is a view for describing the operation of the moving mechanism of the throttle operating device according to the second embodiment, and is a view illustrating the main part of the internal structure of the grip of the brush/weed cutter.
Figure 12B:
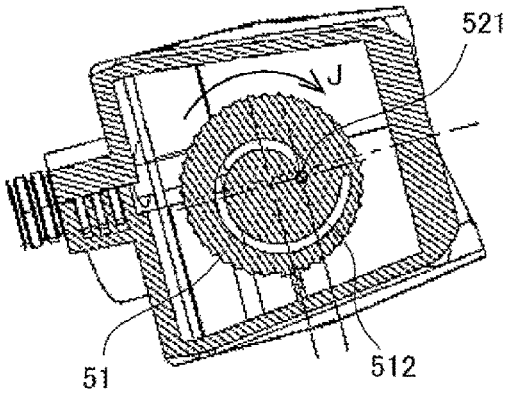
FIG. 12B is an I-I sectional view of FIG. 12A.

FIG. 12A illustrates the main part of the internal structure of the grip 6 in a state in which the throttle lever side end 121*a* of the outer tube 121 is separated farthest from the throttle lever 11, and FIG. 12B is an I-I sectional view of FIG. 12A.

As illustrated in FIGS. 12A and 12B, the first pin 521 of the tube holding part 52 is located at an inner end of the groove 512 formed in the rotation operating part 51, in a state in which the throttle lever side end 121*a* (that is, the tube holding part 52) of the outer tube 121 is separated farthest from the throttle lever 11 (refer to FIG. 12B). Additionally, the second pin 522 is located in the pin support part 68 on a side closest to the power unit 3 (engine 31) (refer to FIG. 12A).

If the rotation operating part 51 is rotated in a direction of arrow J from a state illustrated in FIGS. 12A and 12B, since the first pin 521 is inserted into the spiral groove 512, the tube holding part 52 moves (moves linearly) in a direction toward the throttle lever 11. Accordingly, the throttle lever side end 121*a* of the outer tube 121 moves in the direction toward the throttle lever 11, that is, in the direction in which the tension of the inner cable 122 is loosened, and is held in place as it is.

If an operator rotationally operates the throttle lever 11 while operating the lock-releasing lever 13, the throttle operating device 10B in the present embodiment opens the throttle valve THV via the inner cable 122 (and the valve opening and closing member). Specifically, the inner cable 122 is pulled by the movement of the cable fixing part 113 accompanying the rotational operation of the throttle lever 11 by the operator, and thereby, the throttle valve THV is opened from the idling rotation opening degree to an opening degree according to the amount of rotational operation of the throttle lever 11.

Then, if the operator stops the rotational operation of the throttle lever 11 and lifts his/her hand (finger) from the throttle lever 11, the throttle lever 11 returns to the initial rotation position, and the opening degree of the throttle valve THV returns to the idling rotation opening degree (minimum opening degree). Thereafter, the operator is able to operate, for example, a stop switch (not illustrated), etc., to thereby stop the engine 31.

Additionally when the engine 31 is stopped, the operator is able to move the throttle lever side end 121*a* of the outer tube 121 along the longitudinal direction of the inner cable 122 by means of the moving mechanism 50 provided in the grip 6, thereby changing and adjusting the tension of the inner cable 122. Specifically, the operator is able to change and adjust the tension of the inner cable 122 by appropriately rotating (the second shaft 513 of) the rotation operating part 51 using the flathead screwdriver, etc., to thereby move the tube holding part 52 along the longitudinal direction of the inner cable 122 and thereby move the throttle lever side end 121*a* of the outer tube 121 along the longitudinal direction of the inner cable 122.

The throttle operating device 10B according to the present embodiment has the moving mechanism 50, which moves the position of the throttle lever side end 121*a* of the outer tube 121 along the longitudinal direction of the inner cable 122, within the grip 6, in other words, in the vicinity of the throttle lever 11. It is also possible to move the throttle lever side end 121*a* of the outer tube 121 along the longitudinal direction of the inner cable 122 by means of the moving mechanism 50, thereby changing (adjusting) the tension of the inner cable 122. Therefore, the operator is able to perform the change (adjustment) of the tension of the inner cable 122 by the moving mechanism 50, and the checking of the tension of the inner cable 122 by the rotational operation of the throttle lever 11, in the grip 6, that is, at the substantially same position. For this reason, the workability of the adjustment work of the tension of the inner cable 122 is improved similar to in the throttle operating device 10A according to the first embodiment.

Here, the moving mechanism 50 includes: the substantially disk-shaped rotation operating part 51 that is rotationally operated by the operator and has the spiral groove 513 formed on the side surface thereof on the outer tube 121 side; and the tube holding part 52 having the pin (first pin 521) that fixes and holds the throttle lever side end 121*a* of the outer tube 121 and is inserted into the spiral groove 513 formed on the rotation operating part 51. The moving mechanism 50 is configured so as to move the throttle lever side end 121*a* of the outer tube 121 in the direction in which the tension of the inner cable 122 is strengthened by the rotation operating part 51 being rotated in the first direction, and so as to move the throttle lever side end 121*a* of the outer tube 121 in the direction in which the tension of the inner cable 122 is loosened by the rotation operating part 51 being rotated in the second direction opposite to the first direction. For this reason, similar to the throttle operating device 10A according to the first embodiment, also in the throttle operating device 10B according to the present embodiment, the tension of the inner cable 122 is able to be finely changed, and the tension of the inner cable 122 can also be easily and finely adjusted.

Additionally, the rotation operating part 51 has the shaft (the second shaft 513) that is exposed to the outer surface of the grip 6, and is rotated in the first direction or the second direction by the second shaft 513 being rotationally operated. The tip surface of the second shaft 513 is formed with the concave groove into which a tip portion of a tool, such as a flathead screwdriver, is insertable, and the tip surface of the second shaft 513 is exposed to the inside of the ring-shaped projection 67 formed on the outer surface of the grip 6. For this reason, unintentional rotation of the rotation operating part 51 (that is, the change of the tension of the inner cable 122) is prevented while the stable and reliable rotational operation of the moving mechanism 50 by the operator is allowed.

In addition, in the present embodiments, the shaft (second shaft 513) of the rotation operating part 51 is configured so as to be rotationally operated, but the invention is not limited thereto. For example, a configuration may be adopted in which all or a part of an outer peripheral surface of the rotation operating part 51 is exposed outside of the grip 6, and the operator rotationally operates the rotation operating part 51 via the portion exposed outside of the grip 6. According to the throttle operating device of the invention, the tension of the inner cable is adjustable by moving the cable fixing part using the moving mechanism. Here, since the throttle operating device has the moving mechanism within the throttle lever, the operator is able to change the tension of the inner cable by the moving mechanism, and check the tension of the inner cable by the rotational operation of the throttle lever, at substantially the same position. For this reason, compared to the related art, the tension of the inner cable is able to be easily adjusted, and the workability of the adjustment work of the tension of the inner cable is improved. Additionally, since the inner cable is changed in direction within the throttle lever, the degree of freedom is obtained in the arrangement of the moving mechanism within the throttle lever, and the moving mechanism can be arranged at a suitable position.

Although the embodiments and the modification examples of the invention have been described above, the invention is of course not limited to the above-described embodiments and modification examples, and further alterations and modifications are possible without departing from the technical idea of the invention.

What is claimed is:

1. A throttle operating device that adjusts the opening degree of a throttle valve of an engine, the throttle operating device comprising:

a grip;

a throttle lever rotatably attached to the grip, the throttle lever rotationally operated with respect to the grip;

a cable fixer provided in the throttle lever;

an inner cable that is inserted through an outer tube, the inner cable having one end fixed to the cable fixer, and the other end coupled to a valve opener and closer that opens and closes the throttle valve; and a mover that is provided in the throttle lever and moves the cable fixer along a longitudinal direction of the inner cable, wherein the one end of the inner cable is fixed to the cable fixer with the extending direction of the inner cable changed within the throttle lever, wherein the mover includes an adjustable screw that is screwed into a female thread portion formed in the cable fixer, and wherein the mover is configured so as to move the cable fixer in a direction in which the inner cable is pulled by the adjustable screw being rotated in a first direction and so as to move the cable fixer in a direction in which the inner cable is loosened by the adjustable screw being rotated in a second direction opposite to the first direction.

2. The throttle operating device according to claim 1, wherein the inner cable is bent at an acute angle within the throttle lever and is changed in direction.

3. The throttle operating device according to claim 1, wherein the throttle lever has a cable guide for bending the inner cable and changing the extending direction of the inner cable.

4. The throttle operating device according to claim 3, wherein the throttle lever has an engagement region that is operated by an operator, and wherein the cable guide is formed substantially in a U-shape that becomes convex in a direction moving away from the engagement region.

5. The throttle operating device according to claim 3, wherein the cable fixer is arranged on an imaginary extension line of the cable guide.

6. The throttle operating device according to claim 1, wherein the adjustable screw is supported such that an under-head portion and a tip-side portion sandwiching a trunk portion having a male thread portion to be screwed into the female thread portion formed in the cable fixer are rotatable.

7. The throttle operating device according to claim 1, wherein a head portion of the adjustable screw is exposed to an outer surface of the throttle lever so as to allow an operator to perform a rotational operation.

8. The throttle operating device according to claim 1, wherein a head portion of the adjustable screw is exposed to the inside of a concave portion that is formed in an outer surface of the throttle lever so as to allow an operator to perform a rotational operation.

9. A throttle operating device in which one end of an inner cable inserted through an outer tube is fixed to a cable fixer provided in a throttle lever rotatably attached to the grip and which adjusts the opening degree of a throttle valve of an engine via the inner cable by the throttle lever being rotationally operated with respect to the grip, wherein the one end of the inner cable is fixed to the cable fixer with the extending direction of the inner cable changed within the throttle lever, wherein a mover that moves the cable fixer along a longitudinal direction of the inner cable is provided in the throttle lever, wherein the mover includes an adjustable screw that is screwed into a female thread portion formed in the cable fixer, and wherein the mover is configured so as to move the cable fixer in a direction in which the inner cable is pulled by the adjustable screw being rotated in a first direction and so as to move the cable fixer in a direction in which the inner cable is loosened by the adjustable screw being rotated in a second direction opposite to the first direction.

10. The throttle operating device according to claim 9, wherein the adjustable screw is supported such that an under-head portion and a tip-side portion sandwiching a trunk portion having a male thread portion to be screwed into the female thread portion formed in the cable fixer are rotatable.

11. The throttle operating device according to claim 9, wherein a head portion of the adjustable screw is exposed to an outer surface of the throttle lever so as to allow an operator to perform a rotational operation.

12. The throttle operating device according to claim 9, wherein a head portion of the adjustable screw is exposed to the inside of a concave portion that is formed in an outer surface of the throttle lever so as to allow an operator to perform a rotational operation.

* * * * *